US006810788B2

(12) United States Patent
Hale

(10) Patent No.: US 6,810,788 B2
(45) Date of Patent: Nov. 2, 2004

(54) BEVERAGE CARTRIDGE AND FILTER ASSEMBLY

(76) Inventor: Robert Hale, 40 Ridgetop Rd., Scarborough Ontario (CA), M1R 4G3

( * ) Notice: Subject to any disclaimer, the term of this patent is extended or adjusted under 35 U.S.C. 154(b) by 0 days.

(21) Appl. No.: 10/384,126

(22) Filed: Mar. 7, 2003

(65) Prior Publication Data

US 2003/0222089 A1 Dec. 4, 2003

Related U.S. Application Data

(60) Provisional application No. 60/363,940, filed on Mar. 14, 2002, and provisional application No. 60/424,312, filed on Nov. 7, 2002.

(51) Int. Cl.[7] ..... A47J 31/00; B65B 29/02

(52) U.S. Cl. ..... 99/295; 99/323; 426/77; 426/84; 426/433

(58) Field of Search ..... 99/295, 302 R, 99/323, 317, 322; 426/77, 79, 84, 115, 433, 435

(56) References Cited

U.S. PATENT DOCUMENTS

| | | | | |
|---|---|---|---|---|
| 2,778,739 | A | 1/1957 | Rodth | 99/171 |
| 2,783,704 | A | 3/1957 | Liebelt | 99/295 |
| 2,899,886 | A | 8/1959 | Rodth | 99/295 |
| 2,905,075 | A | 9/1959 | Liebelt | 99/295 |
| 2,968,560 | A | 1/1961 | Goros | 99/77.1 |
| 3,292,527 | A | 12/1966 | Stasse | 99/295 |
| 3,607,297 | A | 9/1971 | Fasano | 99/28 |
| 3,615,708 | A | 10/1971 | Abile-Gal | 99/171 |
| 3,628,444 | A | 12/1971 | Mazza | 99/275 |
| 3,823,656 | A | 7/1974 | Vander | 99/295 |
| 3,937,134 | A | 2/1976 | Molenaar et al. | 99/295 |
| 4,136,202 | A | 1/1979 | Favre | 426/77 |
| 4,417,504 | A | 11/1983 | Yamamoto | 99/306 |
| 4,487,114 | A | 12/1984 | Abdenour | 99/295 |
| 4,520,716 | A | 6/1985 | Hayes | 99/306 |
| 4,550,024 | A | 10/1985 | le Granse | 426/77 |
| 4,579,048 | A | 4/1986 | Stover | 99/280 |
| 4,846,052 | A | 7/1989 | Favre et al. | 99/295 |
| 4,859,337 | A | 8/1989 | Woltermann | 210/474 |
| 4,867,993 | A | 9/1989 | Nordskog | 426/77 |
| 4,886,674 | A | 12/1989 | Seward et al. | 426/79 |

(List continued on next page.)

FOREIGN PATENT DOCUMENTS

| | | | |
|---|---|---|---|
| CA | 657233 | | 2/1963 |
| CA | 1219139 | | 3/1987 |
| CA | 2071893 | | 4/1991 |
| CA | 2046558 | | 1/1992 |
| CA | 1304323 | | 6/1992 |
| CA | 2072300 | * | 1/1993 |
| CA | 1318605 | | 6/1993 |

(List continued on next page.)

OTHER PUBLICATIONS

U.S. patent application Ser. No. 2001/0047724, Lazaris et al., filed Dec. 6, 2001.*

*Primary Examiner*—Reginald L. Alexander
(74) *Attorney, Agent, or Firm*—Dinsmore & Shohl LLP

(57) ABSTRACT

A beverage cartridge comprises a container having a sidewall extending from a first surface and a lip provided at an open end of the container. A cover is coupled to the lip of the container to cover the open end and seal the container. A sloped step is formed in the sidewall and a laminated filter structure is coupled to the sloped step. The laminated filter structure subdivides the container to form a brewing chamber and a beverage receiving chamber. The laminated filter structure includes first and second filter elements, both having edge portions. A seal is provided between the edge portions of the first and the second filter elements. The second filter element has a higher wet strength than the first filter element and the second filter element is located downstream of the first filter element. A beverage powder is contained in the brewing chamber. The container is pierceable to allow injection of liquid into the brewing chamber and to allow prepared beverage to be extracted from the container.

19 Claims, 6 Drawing Sheets

U.S. PATENT DOCUMENTS

| | | | | | |
|---|---|---|---|---|---|
| 4,921,712 | A | | 5/1990 | Malmquist | 426/77 |
| 4,975,292 | A | | 12/1990 | Loizzi | 426/77 |
| 5,008,013 | A | | 4/1991 | Favre et al. | 210/482 |
| 5,028,328 | A | * | 7/1991 | Long | 210/477 |
| 5,113,752 | A | | 5/1992 | Brewer | 99/295 |
| 5,190,653 | A | * | 3/1993 | Herrick et al. | 210/477 |
| 5,197,374 | A | | 3/1993 | Fond | 99/295 |
| 5,242,702 | A | | 9/1993 | Fond | 426/433 |
| 5,243,164 | A | | 9/1993 | Erickson et al. | 219/10.55 |
| 5,292,437 | A | | 3/1994 | Ford | 210/478 |
| 5,298,267 | A | | 3/1994 | Gruenbacher | |
| 5,325,765 | A | | 7/1994 | Sylvan et al. | 99/295 |
| 5,327,815 | A | | 7/1994 | Fond et al. | 99/295 |
| 5,343,799 | A | | 9/1994 | Fond | 99/295 |
| 5,347,916 | A | | 9/1994 | Fond et al. | 99/295 |
| 5,398,595 | A | | 3/1995 | Fond et al. | 99/295 |
| 5,398,596 | A | | 3/1995 | Fond | 99/295 |
| 5,424,083 | A | | 6/1995 | Lozito | 426/82 |
| 5,472,719 | A | * | 12/1995 | Favre | 426/77 |
| 5,567,461 | A | | 10/1996 | Lehrer | 426/417 |
| 5,637,335 | A | | 6/1997 | Fond et al. | 426/84 |
| 5,656,311 | A | | 8/1997 | Fond | 426/84 |
| 5,656,316 | A | | 8/1997 | Fond et al. | 426/433 |
| 5,773,067 | A | | 6/1998 | Freychet et al. | 426/506 |
| 5,826,492 | A | | 10/1998 | Fond et al. | 99/295 |
| 5,840,189 | A | * | 11/1998 | Sylvan et al. | 210/474 |
| 5,897,899 | A | | 4/1999 | Fond | 426/112 |
| 5,948,455 | A | | 9/1999 | Schaeffer et al. | 426/77 |
| 6,025,000 | A | | 2/2000 | Fond et al. | 426/433 |
| 2001/0048957 | A1 | | 12/2001 | Lazaris et al. | 426/77 |
| 2002/0015768 | A1 | | 2/2002 | Masek et al. | 426/115 |
| 2002/0020659 | A1 | | 2/2002 | Sweenay et al. | 210/416.3 |
| 2002/0088807 | A1 | | 7/2002 | Perkovic et al. | 220/654 |

FOREIGN PATENT DOCUMENTS

| | | | | |
|---|---|---|---|---|
| CA | 2067515 | | 2/1999 | |
| CA | 2246849 | * | 3/1999 | |
| CA | 2284092 | * | 9/1999 | |
| CA | 2362118 | * | 9/2000 | |
| CA | 2046557 | | 10/2001 | |
| CA | 2046559 | | 10/2001 | |
| EP | 0 114 717 A2 | * | 1/1984 | |
| EP | 0 211 511 A1 | * | 2/1987 | |
| EP | 0 468 078 B1 | * | 1/1992 | |
| EP | 0 468 080 B1 | * | 1/1992 | |
| EP | 0 524 464 A1 | * | 1/1993 | |
| EP | 0 554 469 A1 | * | 8/1993 | |
| EP | 1 190 959 A1 | * | 3/2002 | |
| FR | 2 617 389 | * | 1/1989 | |
| GB | 1427375 | * | 10/1973 | |
| GB | 2 023 086 A | * | 12/1979 | |
| GB | 2183459 | * | 6/1987 | 426/112 |
| NL | 8701627 | * | 2/1989 | |
| WO | WO 00/56629 | * | 9/2000 | |

* cited by examiner

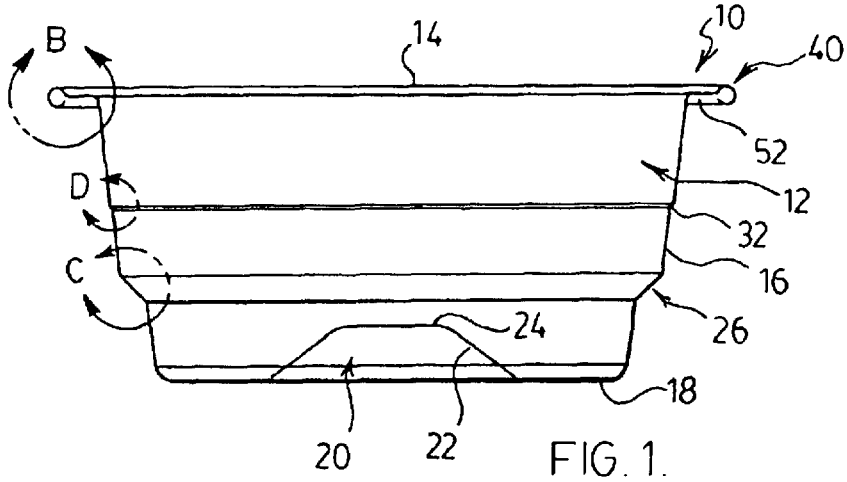
FIG. 1.
FIG. 2.
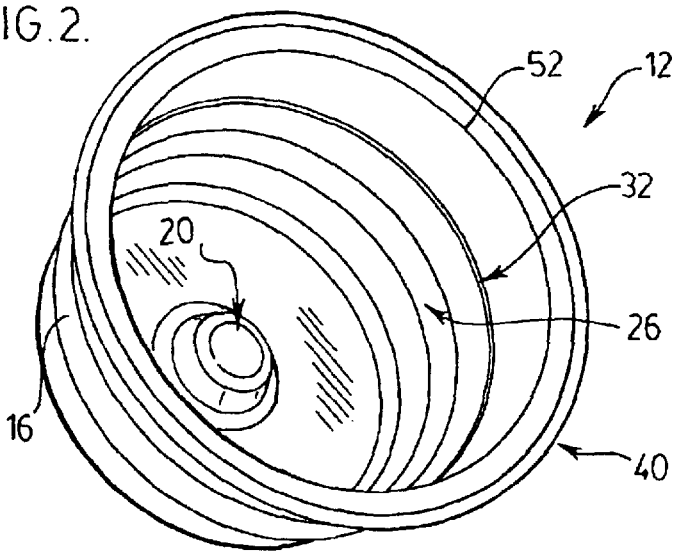
FIG. 3.
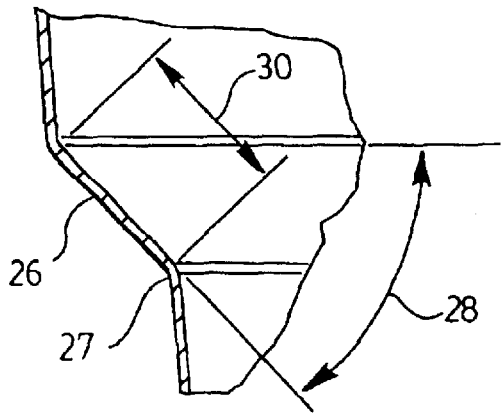

BEVERAGE CARTRIDGE AND FILTER ASSEMBLY

This application claims the benefit of U.S. Provisional Application No. 60/363,940, filed Mar. 14, 2002 and U.S. Provisional Application No. 60/424,312, filed Nov. 7, 2002.

FIELD OF THE INVENTION

The present invention relates to beverage dispensing machines and, in particular, to a beverage cartridge and filter assembly for use in a beverage dispensing machine.

BACKGROUND OF THE INVENTION

Single serving beverage cartridges are very popular because they provide a fresh tasting beverage quickly and conveniently. Beverages such as coffee are typically produced by beverage dispensing machines that use beverage cartridges holding beverage products.

Beverage cartridges typically comprise a sealed container having a top surface, a bottom surface and a filter. The filter subdivides the sealed container to provide an upper brewing chamber for housing a powdered or ground beverage and a lower chamber for receiving the filtered beverage. Beverage cartridges of the prior art are typically comprised of plastic or metal.

Prior art beverage cartridges are often expensive and difficult to manufacture. Reducing the number of processing steps required to form the cartridge typically results in lower item cost and reduces the manufacturing time. Stepped beverage cartridges, such as disclosed in European Patent Application No. 1101430, can be produced using a one-step vacuum forming process when they are manufactured from plastic. Such cartridges are difficult to manufacture when they are formed from a metal, such as aluminum, however.

Installing a filter in a beverage cartridge can be time consuming as several mounting steps are typically required. The heat sealing techniques that are currently employed to fix a filter in a cartridge, have been known to damage the beverage cartridge because the amount of working space inside the cartridge is limited. Some of these production faults are not discovered until the beverage cartridge has reached the consumer.

The type of filter used in a beverage cartridge has significant impact on the quality of the beverage product produced. Paper filters produce a high quality beverage. These filters, however, lack wet strength and can remove too much of the essential coffee oils and flavour. Metal filters, on the other hand, provide sufficient strength. Metal filters, however, allow higher levels of coffee oils to pass through into the brewed beverage. The high levels of produce a different taste in the coffee that is often undesirable. As will be appreciated, a filter is desired that has sufficient dry and wet strength to withstand the high pressures and temperatures associated with brewing but not produce a bitter tasting brewed beverage, as some synthetic filter media are known to do.

It is therefore an object of the present invention to provide a beverage cartridge and filter assembly that obviates or mitigates at least one of the above disadvantages.

SUMMARY OF THE INVENTION

According to one aspect of the present invention, there is provided a laminated filter assembly for subdividing a beverage cartridge to form a brewing chamber. The laminated filter assembly includes a first filter element having a first edge portion, the first filter element being comprised of a first material, a second filter element having a second edge portion, the second filter element being comprised of a second material, the second material differing from the first material. A seal is provided between the first edge portion and the second edge portion. The second filter element has a higher wet strength than the first filter element and the second filter element is located downstream of the first filter element.

According to another aspect of the present invention, there is provided a beverage cartridge comprising a container having a sidewall extending from a first surface and a lip provided at an open end of the container, a cover coupled to the lip of the container to cover the open end and seal the container, a sloped step formed in the sidewall, a filter coupled to the sloped step, the filter subdividing the container to form a brewing chamber and a beverage receiving chamber, and a beverage powder contained in the brewing chamber. The container is pierceable to allow injection of liquid into the brewing chamber and to allow prepared beverage to be extracted from the container.

According to another aspect of the present invention, there is provided a beverage cartridge including a container having a sidewall extending from a first surface and a lip provided at an open end of the container. A cover is coupled to the lip of the container to cover the open end and seal the container. A step is formed in the sidewall and a laminated filter structure is coupled to the step, the laminated filter structure subdividing the container to form a brewing chamber and a beverage receiving chamber. A beverage powder is contained in the brewing chamber. The laminated filter structure has a first filter element with a first edge portion, a second filter element with a second edge portion. A seal is provided between the first edge portion and the second edge portion. The second filter element is of a different material than the first filter element. The second filter element has a higher wet strength than the first filter element and the second filter element is located downstream of the first filter element. The container is pierceable to allow injection of liquid into the brewing chamber and to allow prepared beverage to be extracted from the container.

It is an advantage of an aspect of the present invention that a filter assembly is provided that has sufficient strength to withstand high pressures.

In another aspect, the sloped step allows the filter to be fused thereto more quickly and efficiently. The present invention provides a further advantage in that the stepped beverage cartridge can be manufactured by a single processing step regardless of the type of material that it is comprised of.

BRIEF DESCRIPTION OF THE DRAWINGS

Embodiments of the present invention will now be described more fully with reference to the accompanying drawings in which:

FIG. 1 is a side sectional view of a beverage cartridge according to the present invention;

FIG. 2 is an isometric view of a container of the beverage cartridge of FIG. 1;

FIG. 3 is an enlarged view of detail C of FIG. 1;

DETAILED DESCRIPTION OF THE PREFERRED EMBODIMENTS

Figure 4:
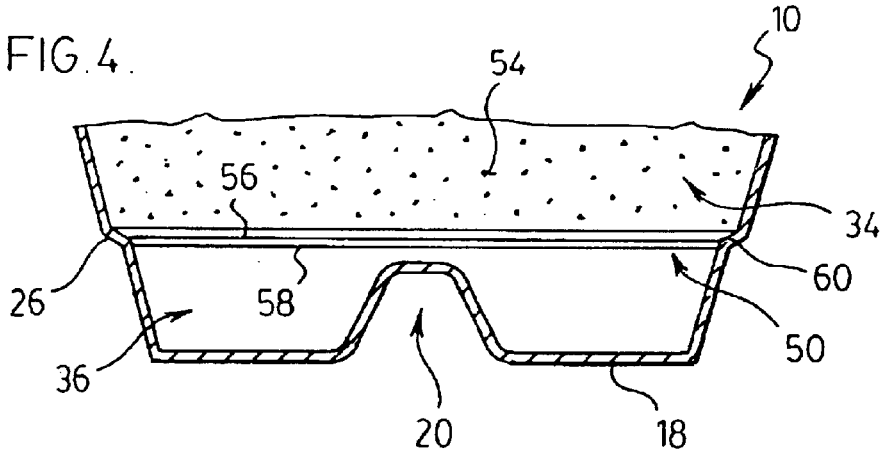
FIG. 4 is a side sectional view of a portion of the beverage cartridge of FIG. 1 including a filter.

Referring to FIG. 1, a beverage cartridge is indicated generally by the numeral 10. The beverage cartridge 10 includes a container 12 and a cover 14. The container 12, which is shown in FIG. 2, includes a generally conical shaped sidewall 16 having a sloped step 26 and a shoulder 32 formed therein. The sidewall 16 extends from a generally circular bottom wall 18 to an upper edge 52 of the container 12. A lip 40 extends outwardly from the upper edge 52 of the container 12. The bottom wall 18 of the container 12 includes a recess 20. The recess 20 is defined by a generally conical shaped wall 22 that extends upwardly from the bottom wall 18 and an offset bottom wall 24.

The sloped step 26, which is shown in FIGS. 1 and 3, is inclined at an angle 28 relative to a plane parallel to the bottom wall 18 of the container 12. The sloped step 26 has a length 30 and extends around the circumference of the container 12. The angle 28 is preferably 45 degrees, however, angles of between 55 and 90 degrees may also be used.

A filter 50, which is shown in FIG. 4, is coupled to the sloped step 26 about an outer edge 60 of the filter 50. The filter 50 subdivides the beverage cartridge 10 into a brewing chamber 34, which is located between the cover 14 and the filter 50, and a beverage receiving chamber 36, which is located between the filter 50 and the bottom wall 18. The brewing chamber 34 contains a powdered beverage product 54 for mixing with a liquid. Following mixing, the liquid is passed through the filter 50 to provide a brewed beverage. The brewed beverage is retrievable from the beverage receiving chamber 36.

Figure 5A:
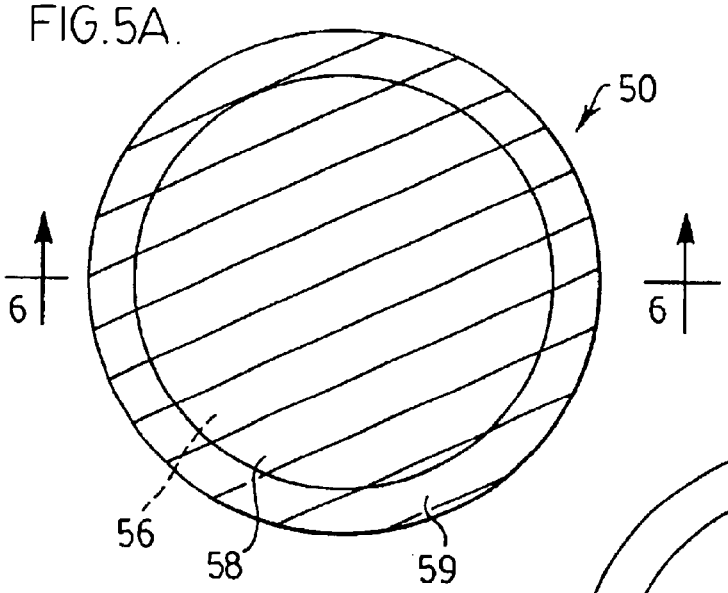
FIG. 5A is a top view of the filter of FIG. 4.
Figure 5B:
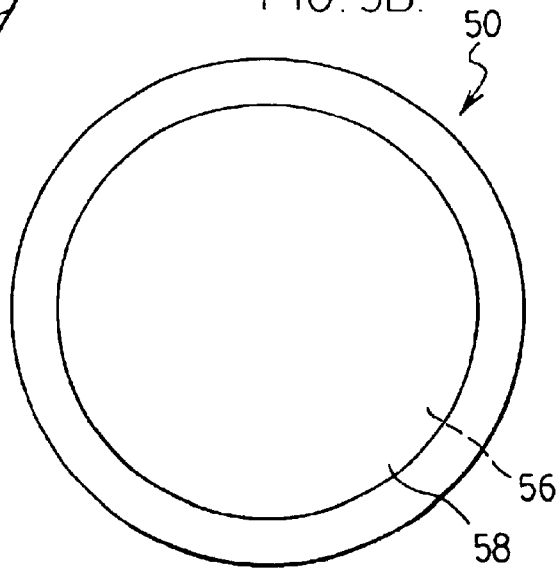
FIG. 5B is a top view of an alternative embodiment of the filter of FIG. 4.
Figure 6:
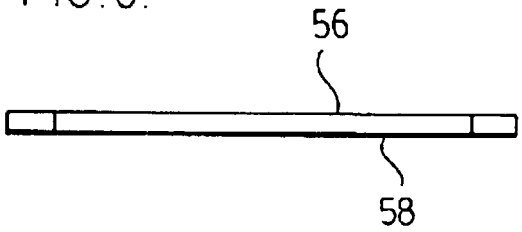
FIG. 6 is a sectional view along 6—6 of the filter of FIG. 5A.

The filter 50 is a laminated structure having first, second and third filter elements 56, 58 and 59, respectively, that are welded to one another about their edges, as best shown in FIGS. 5 and 6. In a preferred embodiment, the first filter element 56 is comprised of a blend of cellulose and polymer fibres. The first filter element 56 offers good particle retention, infusion and taste neutrality, all of which are desirable when producing a brewed beverage product. An example of a suitable material for the first filter element is Type 483402 filter paper, which is supplied by J R Crompton USA Ltd.

The second filter element 58 is comprised of a porous layer of a relatively high strength material, such as a polymer. The second filter element 58 is located downstream of the first filter element 56 and provides added support thereto because it has a higher wet strength. The addition of the second filter element 56 enables the filter 50 to withstand high liquid pressures in excess of 3 bar and liquid temperatures of up to at least 200 degrees Fahrenheit, while maintaining the brewing characteristics of the first filter element 56. A suitable material for the second filter element 58 is Dupont Vexar Standard E-2082. The second filter element 58 is made from any non-woven polymer material that is compatible with the first filter element 56 and the cartridge. In the present embodiment, the second filter element 58 is a polypropylene material of sufficient strength to withstand water pressures of from 0.5 to 5 bar and water pressures of up to 210 degrees Fahrenheit.

In a preferred embodiment, the second filter element 58 is made from a polypropylene diamond shaped extruded or molded material. The diamond shaped extruded material includes strands that are welded or joined together to inhibit separation of the strands. This is advantageous over woven filters, which tend to separate at the time of cutting. The diamond shaped extruded material is expandable to accommodate the first filter element 56, which expands due to the heat and pressure produced during the brewing process. Thus, the second filter element 58 is elastic to allow expansion, thereby increasing the gross area of the filter 50. The elasticity of the second filter element 58 is limited, however, to provide support for the first filter element 56, without fracture or splitting of the first filter element 56. The second filter element 58 therefore forms an effective supporting structure without inhibiting the ability of the first filter element 56 from performing effectively.

In both the first and second filter elements 56, 58, the weight and/or porosity govern the extraction level of the filtered beverage. It will be appreciated by those skilled in the art that the weight and/or porosity may be varied in order to achieve the desired filtration.

The third filter element 59 comprises a plurality of polyester threads that are laminated to a downstream side of the second filter element 58.

The filter 50 is die stamped and the first, second and third filter elements 56, 58, 59, respectively, are welded together at respective outer edges thereof. The weld process is performed when the filter 50 is formed, prior to being secured inside the beverage cartridge 10. During the weld process, the second filter element 58 melts, thereby sealing to the first filter element 56 and the edges of the polyester threads of the third filter element 59 are welded to the second filter element 58, on the opposite side as the first filter element 56. The heat passes through the second filter element 58 to the first filter element 56 such that the first filter element 56 is not scorched. The third filter element 59 serves to further strengthen the resulting filter 50.

The outer edge 60 of the filter 50 is preformed to the shape shown in FIG. 4 and heat sealed to the sloped step 26. In order for a good seal to be provided in the beverage cartridge 10, the melt point of the second filter element 58 is lower than the melt point of the container 12. This ensures that the edge portion of the second filter element 58 melts to the sloped step 26 in the heat sealing process. The length 30 of the sloped step 26 is maximized in order to provide sufficient surface area for securing the filter 50 thereto. The sloped step 26 provides a larger surface area for welding than a generally right angled step, which results in a higher strength welded connection. Advantageously, the stress concentration on the filter that is caused by a right angled step is reduced by the use of the sloped step 26.

During the heat sealing process, the heat sealing device contacts the container 12 on the external side of the sloped step 26. Therefore, the sloped step 26 of the container is heated and the second filter element 58 melts, thereby bonding the filter 50 to the sloped step 26. An additional advantage of the sloped step 26 is that the filter 50 is less likely to break at a location adjacent the fused outer edge 60 thereof. This portion of the filter 50 is in contact with a lower edge 27 of the sloped step. In a generally right-angled step, the lower edge is much sharper, which can cause damage to the filter 50.

Advantageously, the filter 50 bows when in use and the offset bottom wall 24 provides a support for the filter 50 which bows downwardly when in use. The sloped step 26 facilitates the downward bowing of the filter 50 and the filter 50 is permitted to expand. The offset bottom wall 24 supports the bowed filter, inhibiting the filter from bowing down to contact a remainder of the bottom wall 18.

In an alternative embodiment, the third filter element 59 is not employed. Thus, the filter 50 includes only the first and second filter elements 56, 58, respectively, as shown in FIG. 5B. This embodiment of the filter 50 is desirable in application where the first and second filter elements 56, 58, respectively, are of sufficient strength to withstand the internal pressure in the cartridge 10.

Figure 7:
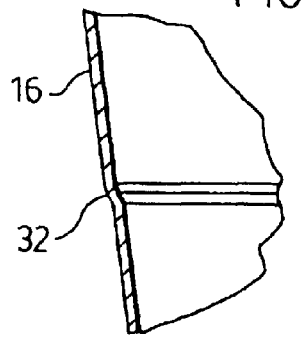
FIG. 7 is an enlarged view of detail D of FIG. 1.

The shoulder 32, which is shown in FIGS. 2 and 7, is spaced between the filter 50 and the cover 14 to create a baffle to direct liquid away from the sidewall 16 of the container 12, towards the centre of the brewing chamber 34. The shoulder 32 facilitates an even distribution of the liquid throughout the brewing chamber 34, which enhances the extraction or dilution process and provides a brewed beverage of a higher quality. The shoulder 32 further functions to increase the strength of the container 12 so that the container 12 is able to withstand internal and external pressures due to the extraction process and handling of the container 12, respectively.

Figure 8:
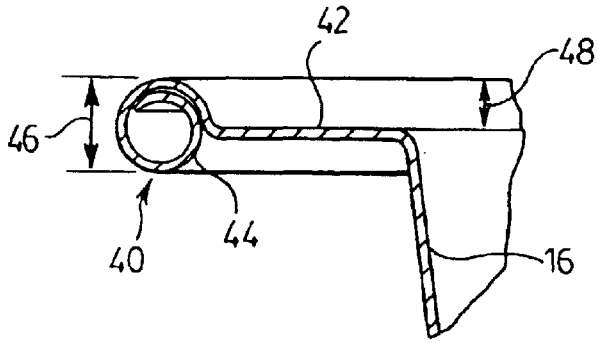
FIG. 8 is an enlarged view of detail B of FIG. 1.

The lip 40, which is shown in greater detail in FIG. 8, includes a generally flat portion 42 that extends outwardly from the upper edge 52 of the sidewall 16 and an outwardly extending coiled portion 44. The coiled portion 44 forms a bead, having an outer diameter 46, around the circumference of the container 12. The coiled portion 44 extends a distance 48 above the upper edge 52 of the container 12 to provide a recess for receiving the cover 14. The distance 48 is approximately equal to half of the outer diameter 46 so that the coiled portion 44 is generally centered relative to the generally flat portion 42.

The lip 40 is used as a reference point for locating the filter 50 with respect to the container 12 and depositing the powdered beverage into the brewing chamber 34 during beverage cartridge assembly. The lip 40 further adds strength to the container 12 and provides surface area to facilitate ejection from a beverage brewing apparatus.

Figure 9:
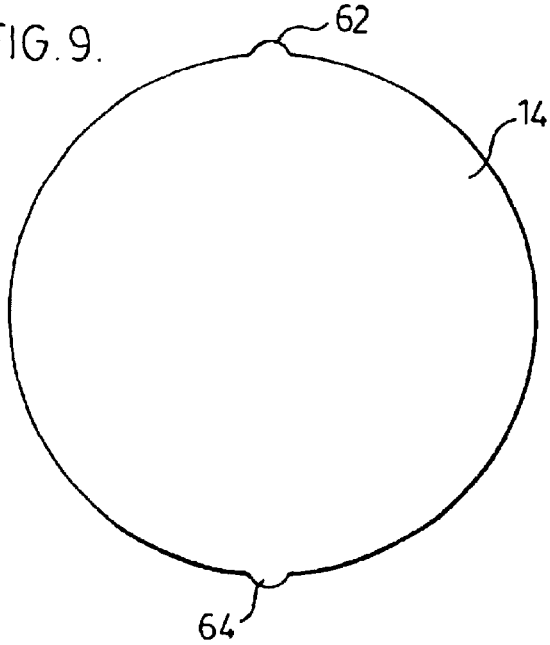
FIG. 9 is a top view of a cover of the beverage cartridge of FIG. 1.

The cover 14 includes a pair of tabs 62, 64 that extend outwardly therefrom, as shown in FIG. 9. Referring to FIGS. 8 and 9, the cover 14 is coupled to the flat portion 42 of the lip 40 of the container 12 and the tabs 62, 64 are coupled to the coiled portion 44. The coiled portion 44 of the lip 40 protects the edge of the cover 14 from accidentally being dislodged from the container 12.

The tabs 62, 64 of the cover 14 are used for centering the cover 14 by aligning the tabs 62, 64 with the lip 40. The tabs 62, 64 further facilitate proper orientation of the beverage cartridge 10 during printing at the time of assembly or thereafter, for example, so that a logo or designation is printed at the same spot on each beverage cartridge 10. Orientation of the beverage cartridge 10 in the beverage brewing apparatus or other applications, can also be controlled using the tabs 62, 64 as locating devices.

The container 12 is comprised of an aluminum sheet having a polypropylene film on one side thereof. The film layer is directed toward the interior of the container 12. The aluminum sheet typically has a thickness of between 0.50 and 1.20 mm. The container 12 is typically formed by a stamping process. The container 12 may also be formed by any other suitable process, such as drop forming, hydro forming, or vacuum forming, for example. A suitable aluminum sheet material for the container 12 is Product Type: B 342go, provided by Alupak AG, or Alcan product no. 3175. The container 12 may alternatively be comprised of a plastic having an oxygen barrier.

After forming the container 12, the filter 50 is coupled to the sloped step 26, as described herein above. Next, the beverage product is deposited into the brewing chamber 34 and the cover 14 is attached to the container, thereby sealing the cartridge 10.

The cover 14 is comprised of a similar polypropylene coated aluminum foil as the container 12 and is heat-sealed to the lip 40 of the container 12. Alternatively, any material that can be adhered to the polypropylene of the container 12 and offer an effective oxygen barrier may be used. The beverage cartridge 10 is able to withstand water pressures of 0.5 to 9 bar when used in conjunction with an appropriate beverage brewing apparatus.

The beverage cartridge 10 may be produced from aluminum using a one step stamping process. When working with aluminum, defects often occur during the manufacturing process when beverage cartridges having steps disposed at angles of approximately 90 degrees, are produced. The sloped step 26 is advantageous and allows the beverage cartridge 10 to be produced in a single manufacturing step.

The generally conical shaped wall 22 and the offset bottom wall 24 of the recess 20 provide structural rigidity to the container 12. In this embodiment, the filter 50 is spaced from the offset bottom wall 24 prior to brewing. The offset bottom wall 24 provides support to the filter 50, which expands during the brewing process. The recess 20 functions to inhibit the filter 50 from touching the bottom wall 18 of the container 12, which is undesirable because this would inhibit the entire filter area from filtering the beverage product. The recess 20 further serves to limit stretching or expansion of the first filter element 56 in order to prevent the first filter element 56 from fracturing, if the second filter element 58 fails to do so. It is not necessary for the filter 50 to contact the offset bottom wall 24 provided that the second filter element 58 provides sufficient strength to suspend the filter 50 above the bottom wall 18.

The generally conical shaped wall 22 and the offset bottom wall 24 also serve to allow the container 12 to expand by expansion of the bottom wall 18, when the beverage cartridge 10 is under pressure during use. As pressure is applied in the container 12, the bottom wall 18 expands outwardly, thereby increasing the volume of the interior of the container 12. The filter 50 also expands, bowing downwardly in the container 12.

Figure 10:
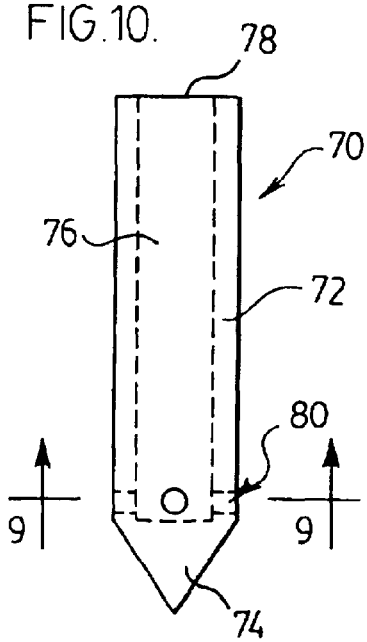
FIG. 10 is a side view of an injector according to an embodiment of the present invention.
Figure 11:
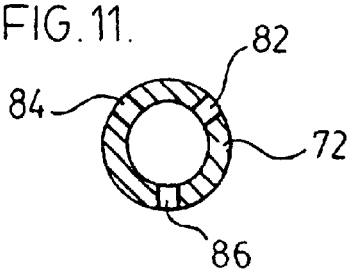
FIG. 11 is a view of 9—9 of FIG. 8.
Figure 12:
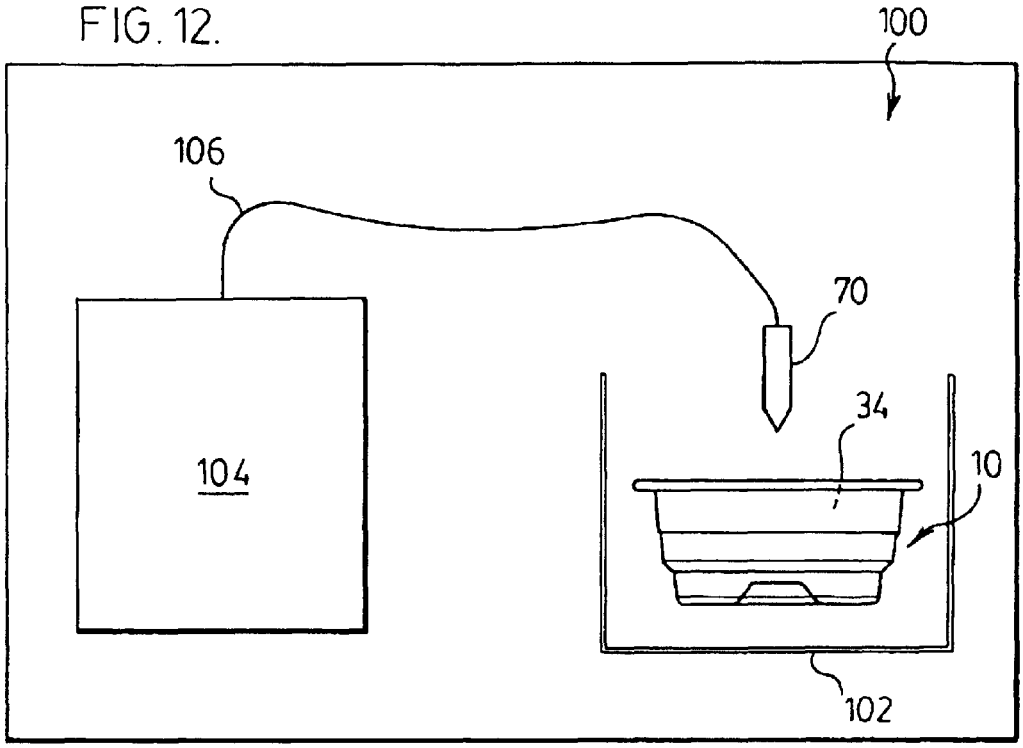
FIG. 12 is a schematic side view of a beverage brewing apparatus and a beverage cartridge according to an embodiment of the present invention.

Referring now to FIG. 10, there is shown an injector 70 for use with a beverage brewing apparatus 100, shown in FIG. 12. The injector 70 includes a generally cylindrical body 72 having a pointed tip 74 for piercing the beverage cartridge 10. The body 72 includes a bore 76 that extends partially therethough. The bore 76 includes an inlet 78 for receiving a liquid and an outlet 80 for delivering the liquid to the brewing chamber 34 of the beverage cartridge 10. As shown in FIG. 11, the outlet 80 includes first, second and third passages 82, 84 and 86, respectively, which are spaced about the generally cylindrical body 72 of the injector 70. In a preferred embodiment, the passages 82, 84 and 86 are spaced apart by an angle of approximately 120 degrees with respect to one another.

As shown in FIG. 12, the injector 70 is mounted above a beverage cartridge receiving cavity 102 of the beverage brewing apparatus 100. The beverage cartridge receiving cavity 102 and injector 70 are movable relative to one another to pierce the beverage cartridge 10 generally from the top, through the cover 14. Liquid travels from the container 104 to the injector 70 through a liquid conduit 106. The location of the passages 82, 84 and 86 allows the liquid to be delivered laterally with respect to the injector 70 to distribute the liquid evenly throughout the beverage powder.

Figure 13:
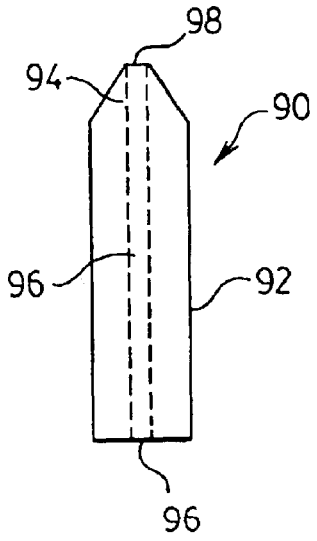
FIG. 13 is a side view of an injector according to another embodiment of the present invention.

Referring to FIG. 13, a second embodiment of an injector 90 is generally shown. The second injector includes a generally cylindrical body 92 and a truncated tip 94. A bore 96 extends through the length of the body 92 and includes an inlet 96 and an outlet 98 for delivering liquid to the beverage cartridge 10.

Figure 14:
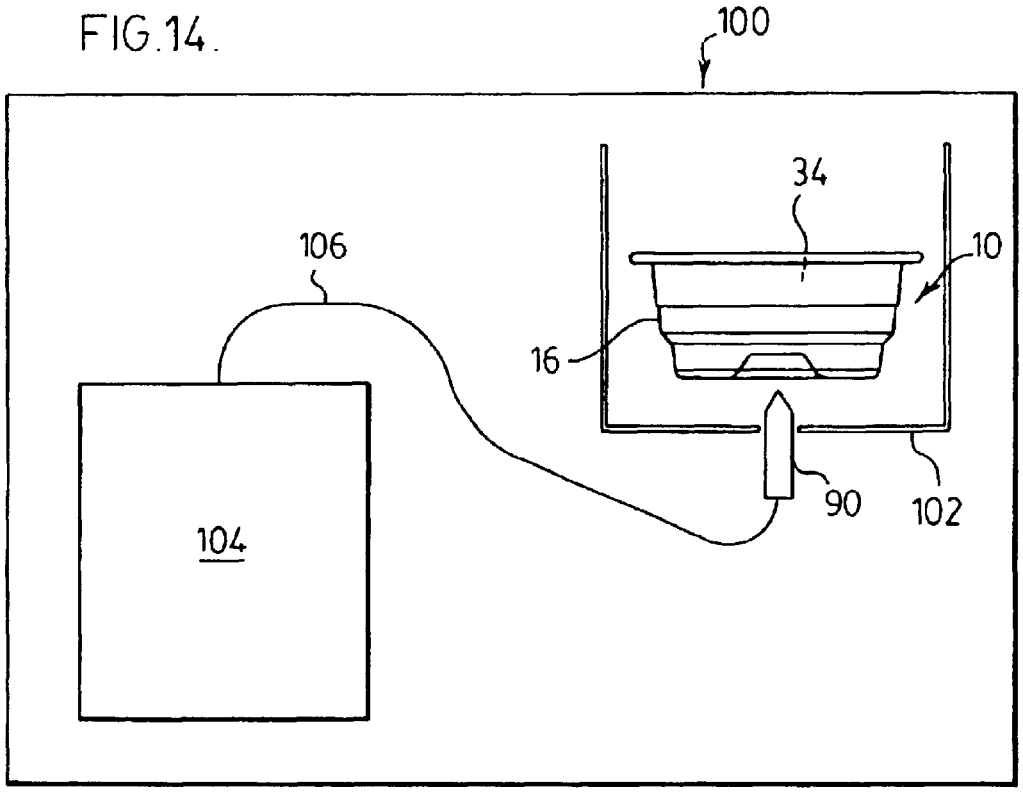
FIG. 14 is a schematic side view of a beverage brewing apparatus and a beverage cartridge according to another embodiment of the present invention.

As shown in FIG. 14, the second injector 90 is mounted below the beverage cartridge receiving cavity 102 of the beverage brewing apparatus 100. The beverage cartridge receiving cavity 102 and the second injector 90 are movable relative to one another to pierce the beverage cartridge 10 generally from below, through the recess 20 and the filter 50. The location of the outlet 98 allows the liquid to be diffused in an upward direction to provide an equal spray over the entire powdered beverage product.

Figure 15:
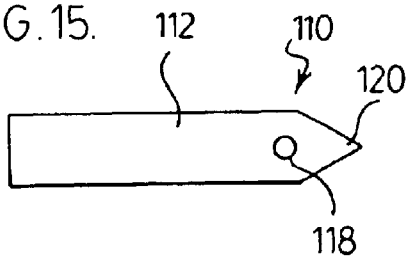
FIG. 15 is a top view of an injector according to still another embodiment of the present invention.
Figure 16:
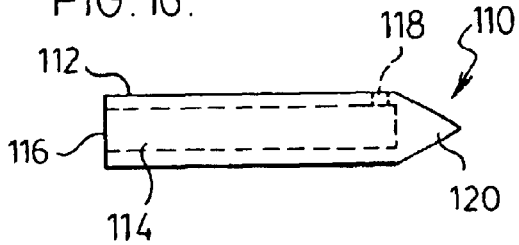
FIG. 16 is a side view of the injector of FIG. 14.

Referring to FIGS. 15 and 16, a third embodiment of an injector 110 is shown. The third injector 110 includes a generally cylindrical body 112 and a pointed tip 120. A bore 114 extends partially through the body 112 and includes an inlet 116 and an outlet 118. The outlet 118 is generally oval shaped to allow a large volume of liquid to be expelled therefrom.

Figure 17:
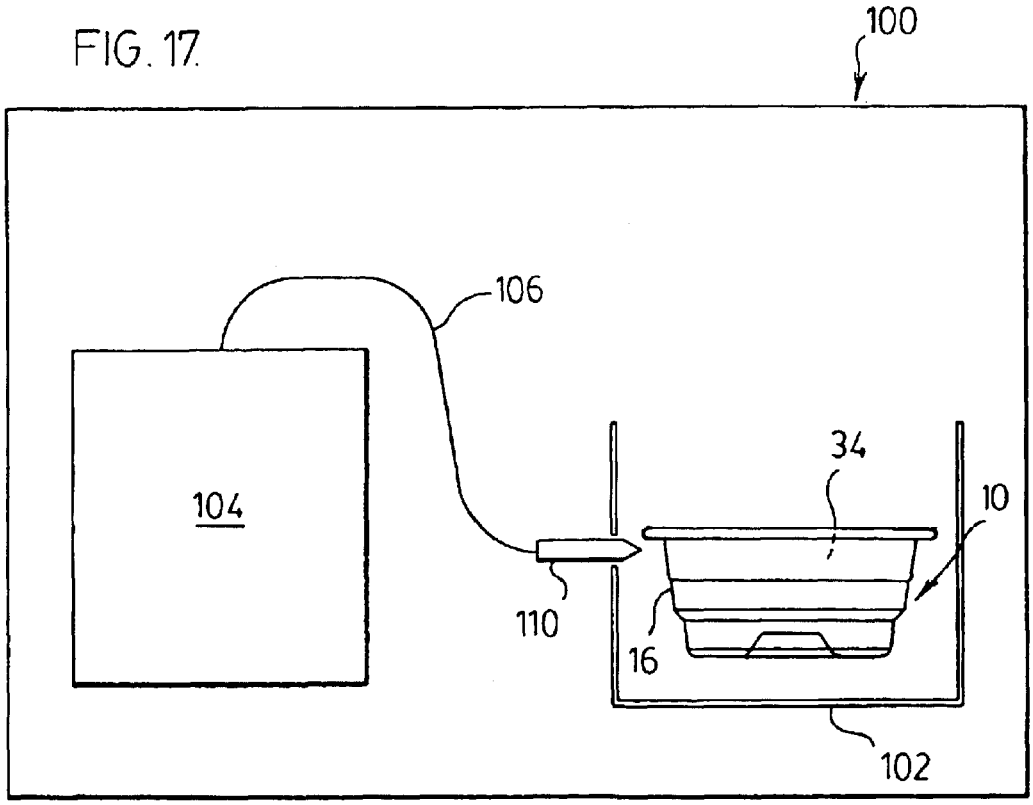
FIG. 17 is a schematic side view of a beverage brewing apparatus and a beverage cartridge according to another embodiment of the present invention.

As shown in FIG. 17, the third injector 110 is mounted adjacent to the beverage cartridge receiving cavity 102 of the beverage brewing apparatus 100. The beverage cartridge receiving cavity 102 and the third injector 110 are movable relative to one another to pierce the beverage brewing chamber 34 of the beverage cartridge 10 generally from the side, through the sidewall 16. The outlet 118 is directed upwardly to facilitate mixing of the liquid with the powdered beverage. The third injector 110 is particularly useful for applications in which it is desirable to agitate the powdered beverage product by allowing the injector 110 to enter the brewing chamber 34 at a location that is slightly above the filter 50. The third injector 110 forces the liquid upward through the powdered beverage to agitate the powdered beverage before the liquid flows through the filter 50.

In use, the beverage cartridge 10 is inserted into the beverage receiving cavity 102 of the beverage brewing apparatus 100. An example of a beverage brewing apparatus that may be used is described in U.S. patent application Ser. No. 10/185,196, which is assigned to the assignee of the present invention and herein incorporated by reference. A liquid injector device having an injector 70, 90 or 110 pierces the beverage cartridge 10 to deliver hot liquid to the brewing chamber. The hot liquid mixes with the powdered beverage. The mixing in the brewing chamber is facilitated by the shoulder 32, which creates a baffle. The hot liquid mixture then passes through the filter 50 and prepared beverage flows into the beverage receiving chamber 36. An extractor device (not shown) pierces the beverage cartridge 10 to extract the prepared beverage.

The beverage cartridge 10 is designed to facilitate entry of the injector 70, 90 or 110 and the extractor device into the container 12. The ideal location of liquid entry and prepared beverage exit from the beverage cartridge 10 is determined based on the powdered beverage product contained and to be extracted.

Once the beverage cartridge 10 has been ejected from the beverage brewing apparatus 100, following beverage preparation, the beverage cartridge 10 may be recycled in its entirety by an appropriate recycling authority. Beverage cartridges made of aluminum are more easily recycled because they do not include the variety of polymers that are typically present in plastic beverage cartridges.

Figure 18:
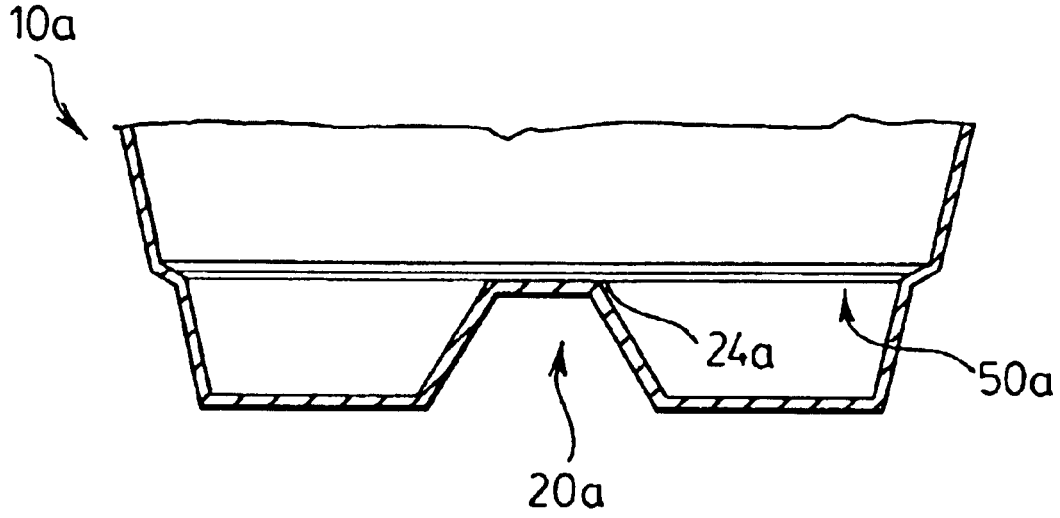
FIG. 18 is a side sectional view of a portion of a beverage cartridge according to another embodiment of the present invention.

Referring to FIG. 18, an alternative embodiment of a beverage cartridge 10*a* is shown. In this embodiment, a filter 50*a* is welded to an offset bottom wall 24*a* of a recess 20*a* by a heat sealing process. The offset bottom wall 24*a* provides support to the filter 50*a*. This is particularly useful in cases where the powdered beverage product is heavy or the pressure of the water injected into the cup if very high. Brewing a beverage in the beverage cartridge 10*a* causes the filter area to be increased as a result of the stretching or expansion of the filter 50*a*. This stretching action (or bowing of the filter) is desirable and is promoted by the manner in which the filter 50*a* is suspended between the sloped step 26 and the offset bottom wall 24*a*.

Figure 19:
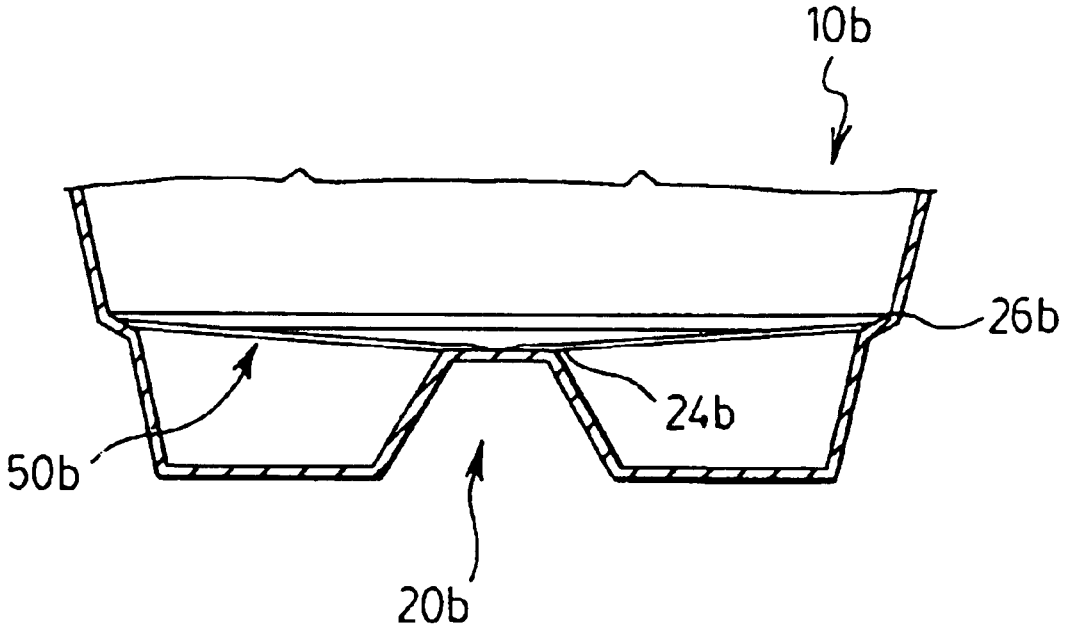
FIG. 19 is a side sectional view of a portion of a beverage cartridge according to yet another embodiment of the present invention.

Another alternative embodiment of a beverage cartridge 10*b* is shown in FIG. 19. A filter 50*b* is welded to an offset bottom wall 24*b* of recess 20*b*. Because the offset bottom wall 24*b* is offset from the plane of sloped step 26*b*, the filter 50*b* is generally concave in shape. This arrangement further promotes expansion of the filter 50*b* to increase the overall filter area.

The filters 50, 50*a* and 50*b* have been shown as being flat or concave, however, it will be appreciated that the filter 50 is not flat when heat sealed to the sloped step 26 of the container 12. Instead, the filters will be fixed to the sloped step 26, causing the edges of the filter 50 to be tilted upwardly. Alternatively, the filter could be conical in shape.

The many features and advantages of the invention are apparent from the detailed specification and, thus, it is intended by the appended claims to cover all such features and advantages of the invention that fall within the true spirit and scope of the invention. Further, since numerous modifications and changes may occur to those skilled in the art, it is not desired to limit the invention to the exact construction and operation illustrated and described, and accordingly all suitable modifications and equivalents may be resorted to, falling within the scope of the invention.

What is claimed is:

1. A beverage cartridge comprising:

a container having a sidewall extending from a first surface and a lip provided at an open end of the container;

a cover coupled to the lip of the container to cover the open end and seal the container;

a step formed in the sidewall;

a laminated filter structure coupled to the step, the laminated filter structure subdividing the container to form a brewing chamber and a beverage receiving chamber, the laminated filter structure having a first filter element with a first edge portion, the first filter element being comprised of cellulose fibres, a second filter element with a second edge portion, the second filter element being comprised of strands of extruded polypropylene fibres that are joined together to inhibit separation of the strands, and a seal provided between the first edge portion and the second edge portion, the second filter element having a higher wet strength than the first filter element and the second filter element being located downstream of the first filter element, such that the elasticity of the second filter element permits expansion of the second filter element under pressure while providing support for the first filter element; and a beverage powder contained in the brewing chamber, wherein the container is pierceable to allow injection of liquid into the brewing chamber and to allow prepared beverage to be extracted from the container.

2. The beverage cartridge according to claim 1, wherein said first filter element is comprised of a blend of cellulose and polymer fibres.

3. The beverage cartridge according to claim 1, wherein said laminated filter structure further includes a third filter element comprised of a third material, fixed to one of said second and said first filter elements, at an edge portion thereof.

4. The beverage cartridge according to claim 3, wherein said third filter element is comprised of polyester.

5. The beverage cartridge according to claim 3, wherein said third filter element is comprised of polyester threads fixed to said second filter element.

6. The beverage cartridge according to claim 1, further comprising a support, offset from the first surface for supporting a portion of the laminated filter structure during brewing.

7. The beverage cartridge according to claim 6, wherein the support comprises a generally conical recess having an offset wall spaced from the first surface.

8. The beverage cartridge according to claim 1, wherein the step is sloped.

9. The beverage cartridge according to claim 8, wherein said laminated filter structure is heat sealed to the sloped step.

10. The beverage cartridge according to claim 1, further comprising a shoulder formed in the sidewall in the brewing chamber, for facilitating distribution of the liquid in the brewing chamber.

11. A process for fabricating the beverage cartridge of claim 1, comprising:

forming the container;

coupling the filter to the step of the container by applying a heating device to an exterior of said container, at said step;

depositing said beverage powder in said brewing chamber of said container; and heat sealing said cover to said lip of said container.

12. The process for fabricating the beverage cartridge according to claim 11, wherein forming the container includes stamping said container from an aluminum sheet having a polypropylene file on one side thereof.

13. The process for fabricating the beverage cartridge according to claim 12, wherein said stamping is a one-step stamping process.

14. The process for fabricating the beverage cartridge according to claim 12, further comprising:

stamping said first and said second filter elements; and welding said first and second filter elements together at outer edges thereof, prior to the step of coupling the filter to the step of the container.

15. A laminated filter structure for subdividing a beverage cartridge to form a brewing chamber, said laminated filter structure comprising:

a first filter element having a first outer edge portion, the first filter element being comprised of cellulose fibres;

a second filter element having a second outer edge portion, the second filter element being comprised of strands of extruded polypropylene fibres that are joined together to inhibit separation of the strands; and a seal provided between said first outer edge portion and said second outer edge portion;

wherein said second filter element has a higher wet strength than said first filter element and said second filter element is located downstream of said first filter element, such that the elasticity of the second filter element permits expansion of the second filter element under pressure while providing support for the first filter element.

16. The laminated filter structure according to claim 15, wherein said first filter element is comprised of a blend of cellulose and polymer fibres.

17. The laminated filter structure according to claim 15, further comprising a third filter element comprising a third material fixed to one of said first and said second filter elements.

18. The laminated filter structure according to claim 17, wherein said third filter element is comprised of polyester.

19. The laminated filter structure according to claim 17, wherein said third filter element is comprised of polyester threads fixed to said second filter element.

* * * * *